US007909627B2

(12) United States Patent
Hill et al.

(10) Patent No.: US 7,909,627 B2
(45) Date of Patent: Mar. 22, 2011

(54) MULTI-AXIS RETENTION MECHANISM

(75) Inventors: Brent A. Hill, Portland, OR (US); Cary D. Cottrell, Olympia, WA (US); Yun Ling, Portland, OR (US); John M. Lynch, Forest Grove, OR (US); Scott Noble, Beaverton, OR (US); Guixiang Tan, Shrewsbury, MA (US); Thai (Daniel) Tong, Beaverton, OR (US); Daniel S. Willis, Portland, OR (US); Yinan Wu, Westborough, MA (US)

(73) Assignee: Intel Corporation, Santa Clara, CA (US)

( * ) Notice: Subject to any disclaimer, the term of this patent is extended or adjusted under 35 U.S.C. 154(b) by 538 days.

(21) Appl. No.: 10/689,789

(22) Filed: Oct. 20, 2003

(65) Prior Publication Data

US 2005/0085113 A1 Apr. 21, 2005

(51) Int. Cl.
*H01R 13/62* (2006.01)

(52) U.S. Cl. ..... 439/153; 439/157

(58) Field of Classification Search ..... 439/153, 439/152, 157, 160, 325, 327, 328
See application file for complete search history.

(56) References Cited

U.S. PATENT DOCUMENTS

| | | | | |
|---|---|---|---|---|
| 4,589,794 | A | 5/1986 | Sugiura et al. | |
| 5,211,568 | A * | 5/1993 | Yamada et al. | 439/157 |
| 5,637,004 | A * | 6/1997 | Chen et al. | 439/157 |
| 5,872,701 | A | 2/1999 | Hayden et al. | |
| 5,928,015 | A * | 7/1999 | Tondreault | 439/157 |
| 6,276,950 | B1 * | 8/2001 | Yodogawa | 439/160 |
| 6,361,343 | B1 * | 3/2002 | Daskalakis et al. | 439/327 |
| 6,551,120 | B2 * | 4/2003 | Daskalakis et al. | 439/328 |
| 6,672,888 | B1 * | 1/2004 | Ku | 439/153 |
| 2004/0190268 | A1 | 9/2004 | Ling et al. | |

OTHER PUBLICATIONS

ISR WO dated Feb. 1, 2005.

* cited by examiner

*Primary Examiner* — Xuong M Chung Trans
(74) *Attorney, Agent, or Firm* — Buckley, Maschoff & Talwalkar LLC

(57) ABSTRACT

An electronic system includes a system board, a connector mounted on the system board, an electronic card attached to the connector, the card overhanging the connector at least on an inward end of the card, and a guide secured to the system board and spaced from the connector, wherein the guide is adapted to inhibit lateral movement of the card. The guide includes a latch adapted to inhibit removal of the electronic card from the connector.

18 Claims, 6 Drawing Sheets

MULTI-AXIS RETENTION MECHANISM

The invention relates to electronic systems, and more particularly to novel connectors and retention mechanisms for add-in cards.

BACKGROUND AND RELATED ART

Many electronic systems provide the capability to supplement the functionality of the system by providing an interface through which additional electronic circuitry can be added to the system. For example, with reference to FIG. 1, a typical computer system 10 provides several connector slots 11 which are adapted to accept add-in cards 12. The add-in cards 12 may be retained by the mechanical forces between the connector 11 on the system board 13 and the card edge connector 14 on the add-in card 12. In many cases a bracket 15 is provided on the add-in card 12 which is secured to the chassis of the system at one end with a screw.

Some memory devices, which are relatively small, include latches on both ends of the memory connector. The latches help retain the memory card in the slot and may also be used to eject the memory card.

The power consumption and complexity of computer add-in cards has been increasing due to performance demands. For example, conventional high performance video cards may require power of about 25 watts and may weigh about 400 grams. As the required power increases, the weight of the add-in card consequently increases due to the need for more complex thermal solutions including larger heat sinks and fans. Even without increased power demands, the mass of the add-in card may increase due to larger card size and more devices and/or components on the add-in card.

If an add-in card is not sufficiently retained, the card can be displaced, or even dislodged from the system board connector, e.g. due to shock and vibration. This can result in an open circuit or even structural damage. The severity of the problem mainly depends on the card mass, the location of the center of gravity, and the card/connector design. Add-in cards with a large relative mass also have more inertia during shock and/or vibration events. The increased card inertia applies a larger impact force on constraining parts of the card such as the card connector. This can potentially cause failures such as the connector housing pulling off from soldered pins and/or other damage on the connector housing itself.

BRIEF DESCRIPTION OF THE DRAWINGS

Various features of the invention will be apparent from the following description of preferred embodiments as illustrated in the accompanying drawings, in which like reference numerals generally refer to the same parts throughout the drawings. The drawings are not necessarily to scale, the emphasis instead being placed upon illustrating the principles of the invention.

DESCRIPTION

In the following description, for purposes of explanation and not limitation, specific details are set forth such as particular structures, architectures, interfaces, techniques, etc. in order to provide a thorough understanding of the various aspects of the invention. However, it will be apparent to those skilled in the art having the benefit of the present disclosure that the various aspects of the invention may be practiced in other examples that depart from these specific details. In certain instances, descriptions of well known devices, circuits, and methods are omitted so as not to obscure the description of the present invention with unnecessary detail.

As noted above, conventional high performance graphics cards may weigh about 400 grams or more. An add-in graphics card supporting the AGP standard may include a tab near the end of the connector to aid in retention of the card when the card is subject to vertical displacement forces. In general, to remove the card, a retention mechanism which engages with the tab must be manually disengaged. The supplemented retention is primarily in the vertical direction. An example of such a retention mechanism is described in U.S. Pat. No. 6,551,120, assigned in common with the present application.

Figure 1:
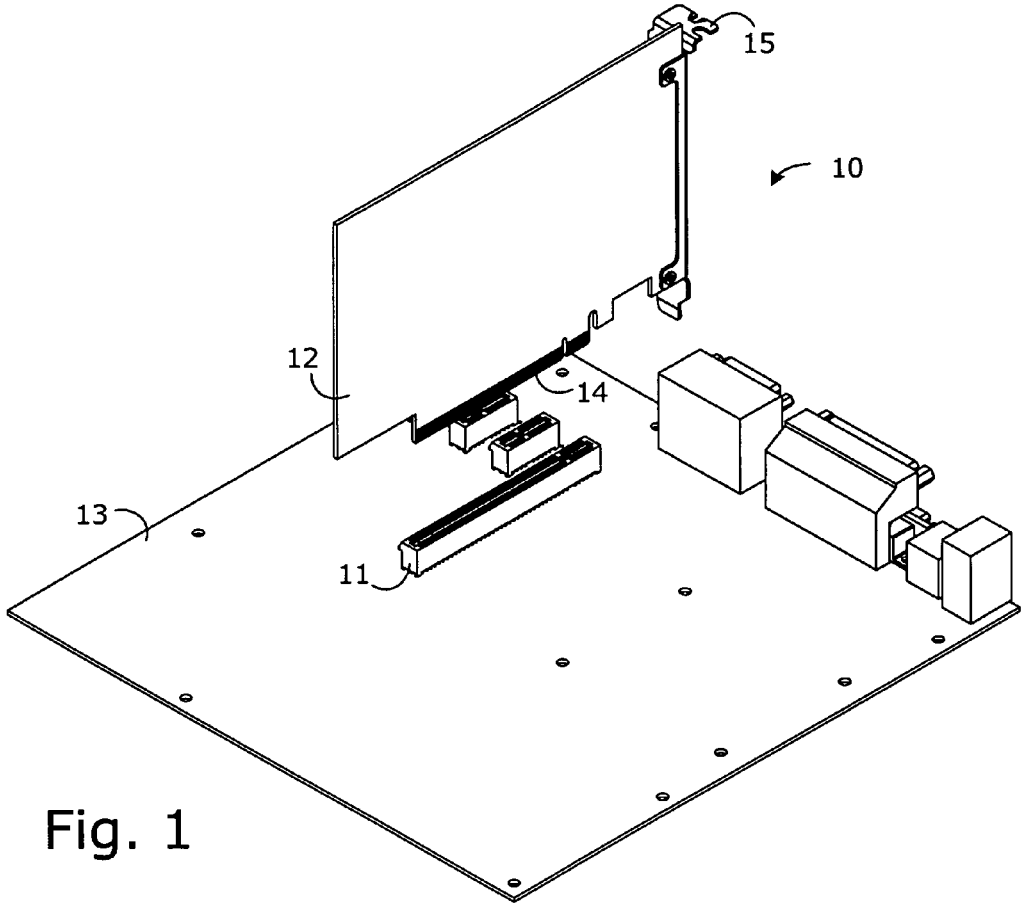
FIG. 1 is a perspective view of a conventional electronic system.
Figure 2:
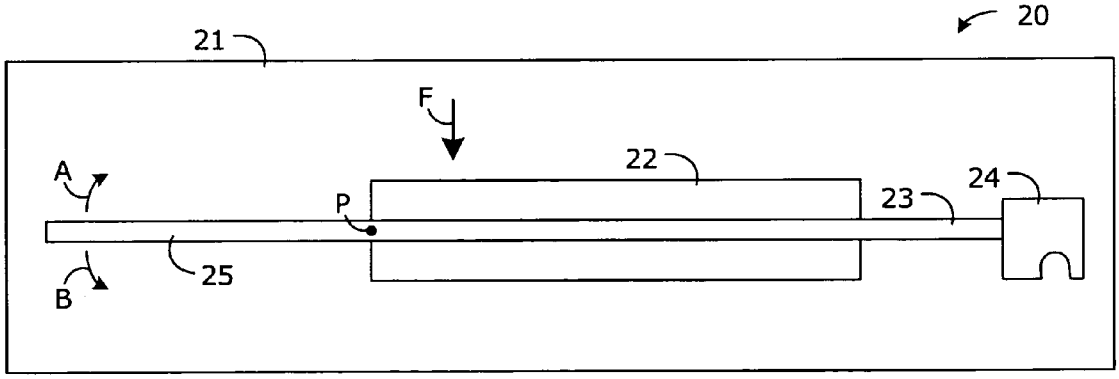
FIG. 2 is a schematic view of a conventional system subject to a lateral force.

The inventors have discovered that with heavier add-in cards (e.g. 400 grams or more), lateral forces on the card can unseat the card and/or cause damage to the system. For example, lateral forces (i.e. forces including a component which is transverse to the plane of the add-in card) may be generated when the electronic system is subject to an impact which is perpendicular to the orientation of the add-in card. With reference to FIG. 2, an electronic system 20 includes a system board 21 with a connector 22 mounted on the system board 21. An add-in card 23 is attached to the connector 22 and overhangs the connector 22 on both ends. The add-in card 23 may include a bracket 24 on one end which may be attached to a chassis of the system 20. When a lateral force F is applied to the card 23, an end 25 of the card (opposite of the bracketed end) may flex, as indicated by the curved arrows A and B. Under lateral forces, a point P near the end of the connector 22 essentially becomes a pivot point about which the flexible material of the card 23 can bend. With a sufficiently heavy card subject to a sufficiently heavy lateral force, the flexing end 25 of the card can torque the card 23 out of the connector 22 and/or cause damage to the card 23, connector 22 and/or system 20.

The inventors have performed extensive tests for heavier cards in a computer system to confirm that card retention failure during shock and vibration conditions may occur due to impacts made perpendicular to the card. Even advanced graphics cards with the additional retention tab fail the tests. It is believed that the conventional supplemental retention tab has limited effect on restricting card deflection during side impact and therefore is not satisfactory to solve the side impact failures. In some instances (e.g. with a 400 gram graphics card), the additional retention tab was broken during shock testing.

Various retention mechanisms providing a side constraint are disclosed in U.S. patent application Ser. No. 10/404,975, filed Mar. 31, 2003, entitled RETENTION MECHANISM FOR HIGH MASS ADD-IN CARDS, assigned in common with the present application.

Figure 3:
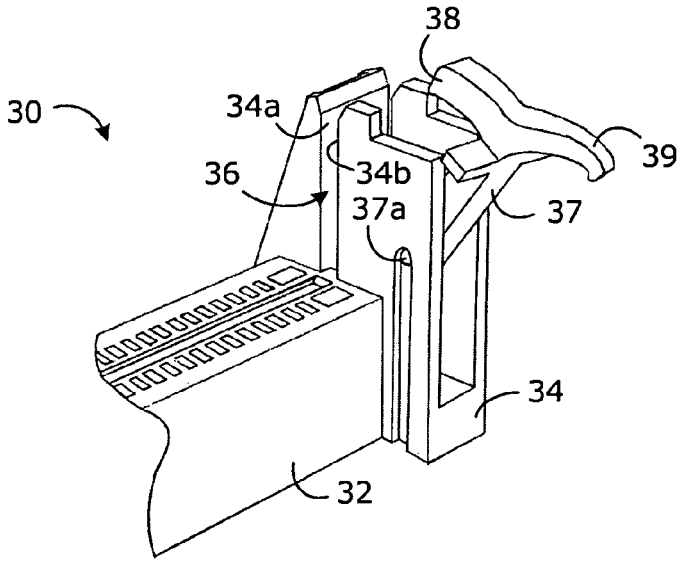
FIG. 3 is a perspective view of a retention mechanism according to some embodiments of the invention.

With reference to FIG. 3, an example retention mechanism 30, according to some embodiments of the invention, provides constraints in multiple axes. For example, the retention mechanism includes a connector 32 and a guide 34. The connector 32 and the guide 34 may be integral or may be separate assemblies. The guide 34 includes spaced apart and opposed side walls 34*a* and 34*b*, which define a relatively tall slot 36. The walls 34*a* and 34*b* are adapted to contact a card inserted in the slot 36 and inhibit lateral movement of the card. For example, the guide 34 contacts one or more side surfaces of the card to reduce the amount the card may flex about the pivot point near the end of the connector 32. Preferably, the guide 34 is adapted to provide a side constraint which substantially prevents lateral flexing of the card at the point where the guide 34 contacts the card. In addition, the guide 34 includes a latch 37 which is adapted to interface with a structure on the card to inhibit vertical movement of the card. For example, the card may include an opening (e.g. a slot or a tab) which is positioned in the slot 36 when the card is seated in the connector 32. The latch 37 is operable to pivot about a pivot point 37*a* and includes a protrusion 38 which is adapted to engage the opening, thereby inhibiting removal of the card without disengaging the latch 37. The latch 37 may include a contact surface 39 for a user to contact when opening and/or closing the latch. In some embodiments, the latch 37 is installed in the body of the guide 44 and pivots perpendicularly to the length of the connector 42. In the illustrated example, the latch 37 is oriented transverse, and preferably perpendicular, to the side walls 34*a* and 34*b* (e.g. the pivot axis is parallel to the lengthwise axis of the connector). Thus, in some embodiments, the retention mechanism 30 inhibits both lateral and vertical movement of the card. With the additional constraint provided by the connector 42 in the X-axis, the card is effectively constrained in all three axes (e.g. lengthwise axis of connector corresponds to the X-axis, lateral movement corresponds to the Y-axis, and vertical movement corresponds to the Z-axis).

An appropriate guide for a particular electronic system may take any suitable form and may be made from any suitable material. Plastic is a preferred material for the guide. Preferably, the guide provides a slot or channel that is a close fit with the thickness of the add-in card. For example, the guide may define a slot between two resilient protrusions (e.g. walls 34*a* and 34*b*). The width of the slot may be less than the thickness of the card, with the protrusions being sufficiently resilient to expand to accept the card. An advantage of the resilient protrusions is that they provide retention forces in the both the vertical and lateral directions, thus supplementing the retention force provided by the latch and the retention tab.

Figure 4:
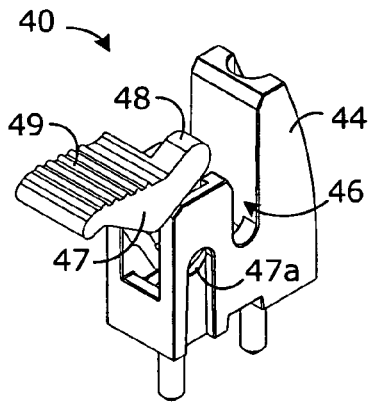
FIG. 4 is a perspective view of another retention mechanism according to some embodiments of the invention, with a latch member is an open position.
Figure 5:
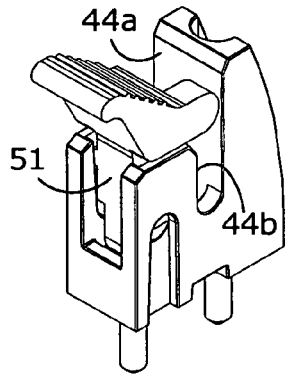
FIG. 5 is a perspective view of the retention mechanism from FIG. 4, with the latch member is a closed position.

With reference to FIGS. 4-5, another retention mechanism 40 includes a guide 44. In some embodiments the guide 44 may be made integral with a connector (not shown). The guide 44 includes spaced apart and opposed side walls 44*a* and 44*b*, which define a relatively shallow slot 46. The guide 44 further includes a latch 47 which is adapted to pivot about a pivot point 47*a* from an open position (see FIG. 4) to a closed position (see FIG. 5). The latch 47 includes a ribbed contact surface 49. In some embodiments, the latch 47 includes a protrusion 48 which may be offset to one side with respect to an arm 51 of the latch 47.

As compared to the embodiment of FIG. 3, the embodiment of FIG. 4 provides a relatively shorter slot. Depending on the requirements of the application, slots of varying height may be provided. For example, a deep slot may be more effective in supporting the card during a Y-axis shock, but requires more clearance area (e.g. keepout) on the card. Conversely, for some applications, a shorter slot may provide sufficient lateral constraint while reducing the keepout impact to the card.

Figure 6:
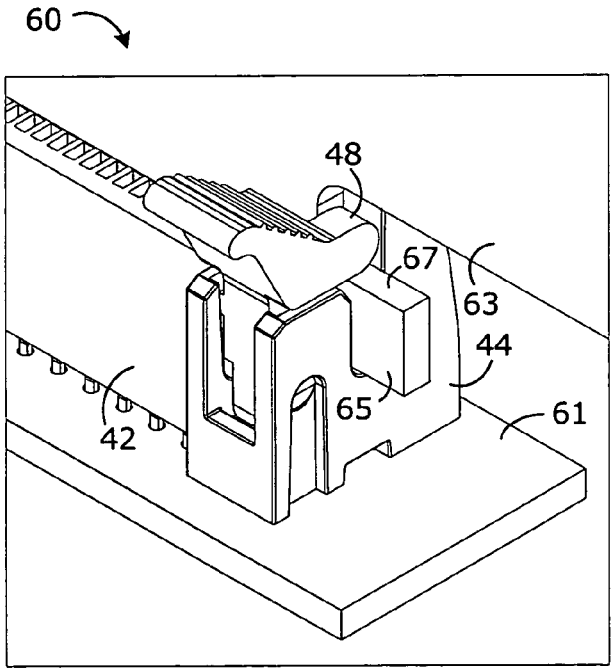
FIG. 6 is a fragmented, perspective view of an electronic system utilizing the retention mechanism from FIG. 4.
Figure 7:
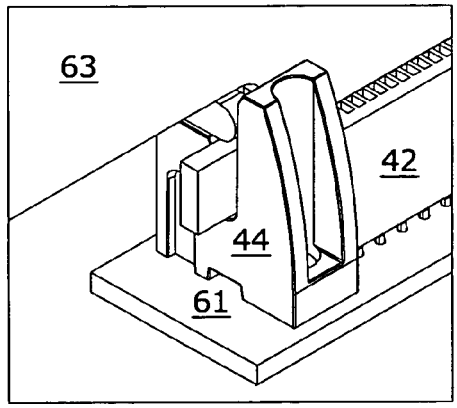
FIG. 7 is another fragmented, perspective view of the electronic system from FIG. 6.

With reference to FIGS. 6 and 7, an electronic system 60 according to some embodiments of the invention includes a system board 61 and a connector 42 mounted on the system board 61. An electronic card 63 is attached to the connector 42 and overhangs the connector 42 (e.g. at least on an inward end of the card 63 with respect to an outer wall of the system chassis). The system 60 further includes the guide 44 secured to the system board 61, where the guide 44 is adapted to inhibit lateral movement of the card 63. In some embodiments, the guide 44 may be spaced from the connector 42. In some embodiments, the guide 44 may abut the connector 42. In some embodiments, the guide 44 may be integral with the connector 42.

For example, the walls 44*a* and 44*b* of the guide 44 may contact one or more side surfaces of the card 63 to reduce the amount the card 63 may flex about the pivot point near the end of the connector 42. Preferably, the guide 44 is adapted to provide a side constraint which substantially prevents lateral flexing of the card 63 at the point where the guide 44 contacts the card 63. With the latch 47 in an open position, the guide 44 allows the card 63 to be inserted into the connector 42. The card 63 includes an extension (e.g. a retention tab) 65 which is positioned in the slot 46 when the card 63 is seated in the connector 42. The latch 47 may them be moved to a closed position. With the latch 47 in the closed position, a surface of the protrusion 48 engages a surface 67 of the tab 65 to inhibit removal of the card 63 or other Z-axis movement of the card 63 out of the connector 42.

In some embodiments, the latch 47 may include a lever design that combines card insertion, retention, and ejection functions. An example of such a multi-function lever design is described in U.S. Patent Publication No. 2003/0137811 A1. For example, the latch 47 may include a base portion between the pivot axis (e.g. about pivot point 47*a*) and the bottom of the guide 44. The base portion may include a protrusion. When the card is positioned in the slot 46, the bottom of the tab 65 (or another portion of the card 63) may contact the protrusion. When the card 63 is pushed into the connector 42, the tab 65 pushes the protrusion and causes the latch 47 to automatically go from the open position to the closed position. Alternatively, the latch 47 may be manually moved from the open position to the closed position to assist in the insertion of the card 63 in the connector 42 (with the protrusion 48 applying an insertion force on the surface 67 of the tab 65). During removal, the latch 47 may be moved from the closed position to the open position to assist in the removal of the card 63 from the connector 42. Specifically, the protrusion on the base portion of the latch 47 contacts a bottom edge of the card 63 and applies a positive vertical removal force which assists in removing the card 63 from the connector 42.

Advantageously, some embodiments of the invention may include a combination of features relating to inhibiting lateral card movement, inhibiting vertical card movement, and providing improved functions for at least one of the card insertion or ejection operations. The numerous possible configurations of the retention mechanisms described herein provide design flexibility, scalability, and have only minor impact on the system board layout.

Any suitable technique may be utilized to secure the guide 44 to the system board 61. For example, the guide 44 may define one or more openings adapted to receive a fastener (e.g. a screw). The system board 61 may provide corresponding mounting holes (not shown). In some embodiments, the system board 61 corresponds to an ATX compatible motherboard. In some embodiments, the guide 44 may be secured to an ATX mounting hole already provided on the motherboard, thus reducing the amount of rework or board re-routing required to utilize the guide 44.

In some embodiments, the guide 44 may include alignment features to aid in the positioning of the slot 36 with respect to the connector 42. For example, a guide may define a plurality (i.e. at least two) of holes which are used as alignment features. Corresponding mounting holes are provided on the system board. The holes may be keyed. The mounting holes may be configured such that when the holes in the guide are aligned with the mounting holes, the slot defined by the guide is aligned with the lengthwise axis of the connector. For example, the guide may be mounted on the system board via two wave-soldered through-hole pins. Other methods of board mounting can also be used such as press-fit, or the addition of snap-in features. Many other variations of the guide and mounting fasteners are possible.

Figure 8:
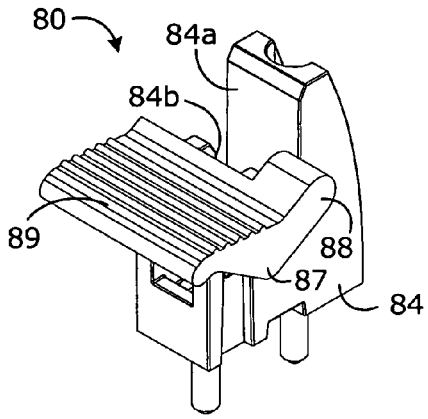
FIG. 8 is a perspective view of another retention mechanism according to some embodiments of the invention, with a latch member in an open position.
Figure 9:
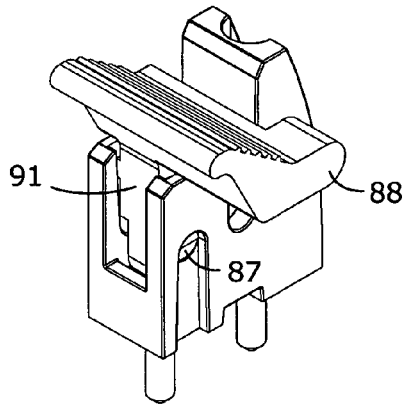
FIG. 9 is a perspective view of the retention mechanism from FIG. 8, with the latch member is a closed position.

With reference to FIGS. 8-9, another retention mechanism 80 includes a guide 84. In some embodiments the guide 84 may be made integral with a connector (not shown). The guide 84 includes spaced apart and opposed side walls 84*a* and 84*b*, which define a slot therebetween The one wall 84*a* is relatively taller than the other opposed wall 84*b*. The guide 84 further includes a latch 87 which is adapted to pivot about a pivot point 87*a* from an open position (see FIG. 8) to a closed position (see FIG. 9). The latch 87 includes a ribbed contact surface 89. In some embodiments, the latch 87 includes a protrusion 88 which may be offset to one side with respect to an arm 91 of the latch 87.

As compared to the embodiment of FIG. 4, the embodiment of FIG. 8 provides a wider contact surface 89, which in some applications may improve the operability. Also, the protrusion 88 is provided with a relatively longer offset from the arm 91, which may increase the leverage during insertion and retention. The guide 84 also provides a relatively taller wall 84*a* on one side of the slot. Having a taller wall on only one side may improve the lateral stability while reducing the impact on the clearance area required for the card.

Figure 10:
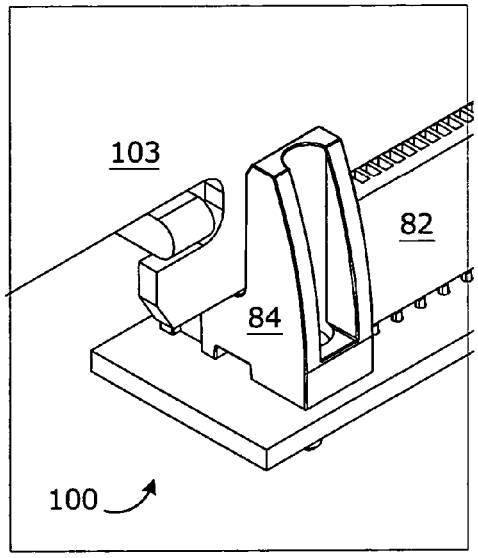
FIG. 10 is a fragmented, perspective view of an electronic system utilizing the retention mechanism from FIG. 8.
Figure 11:
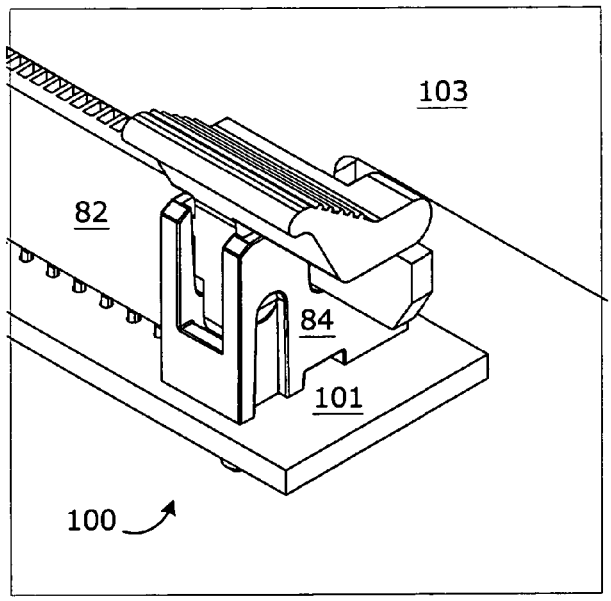
FIG. 11 is another fragmented, perspective view of the electronic system from FIG. 10.

With reference to FIGS. 10 and 11, an electronic system 100 according to some embodiments of the invention includes a system board 101 and a connector 82 mounted on the system board 101. An electronic card 103 is inserted into the connector 82 and overhangs the connector 82 (e.g. at least on an inward end of the card 103 with respect to an outer wall of the system chassis). The system 100 further includes the guide 84 secured to the system board 101, where the guide 84 is adapted to inhibit lateral movement of the card 103. In some embodiments, the guide 84 may be spaced from the connector 82. In some embodiments, the guide 84 may abut the connector 82. In some embodiments, the guide 84 may be integral with the connector 82.

Figure 12:
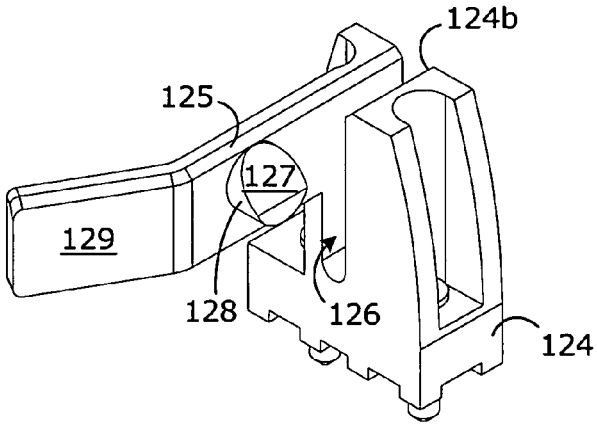
FIG. 12 is a perspective view of another retention mechanism according to some embodiments of the invention.

With reference to FIG. 12, another retention mechanism according to some embodiments of the invention provides a one piece guide with an integral latch. A retention mechanism 120 includes a guide 124 having spaced apart walls 124*a* and 124*b* defining a slot 126 therebetween. A resilient arm 125 extends parallel to the slot 126 from the wall 124*a* (although some embodiments may include a resilient arm along wall 124*b*). The arm 125 includes a protrusion 128 which extends inward toward the slot 126. At an end of the arm 125, distal to the guide 124, the arm includes a contact surface 129 for contact by a user. The protrusion 128 is adapted to cooperate with a corresponding feature in an add-in card, to inhibit removal of the card. The arm 125 may be vertically positioned at any suitable location along the wall 124*a*, although in some embodiments positioning the arm 125 near the top of the wall 124*a* may be preferred.

Figure 13:
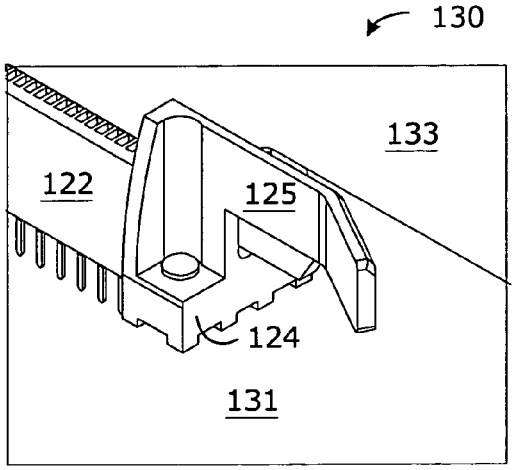
FIG. 13 is a fragmented, perspective view of an electronic system utilizing the retention mechanism from FIG. 12.
Figure 14:
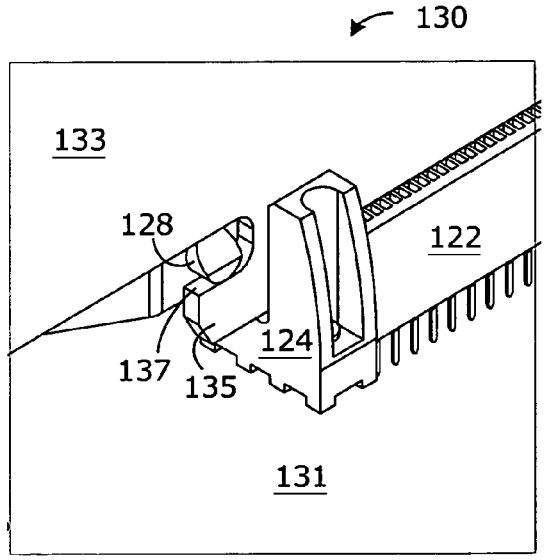
FIG. 14 is another fragmented, perspective view of the electronic system from FIG. 3.
Figure 15:
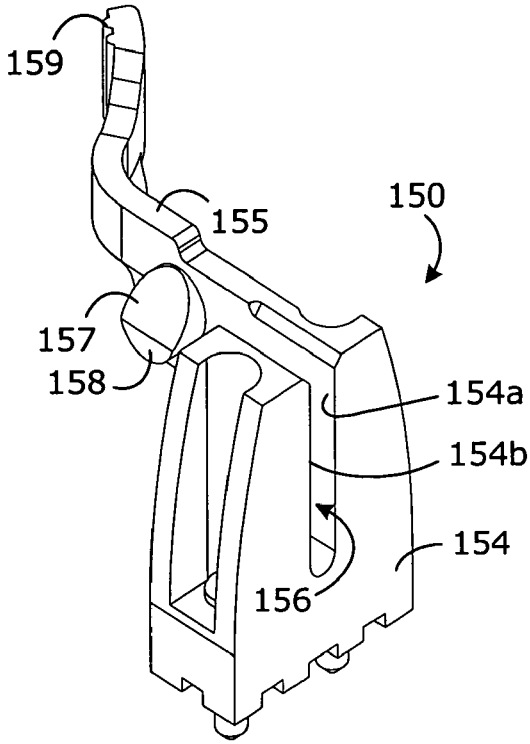
FIGS. 15-18 are perspective views, from various viewpoints, of another retention mechanism according to some embodiments of the invention.
Figure 16:
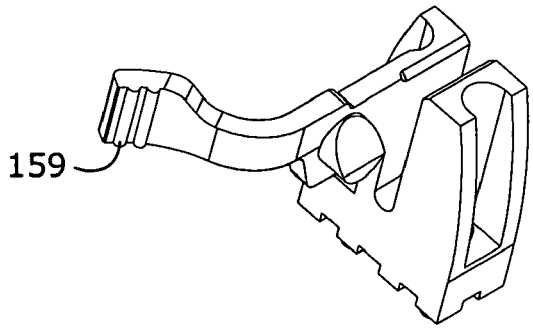
Figure 17:
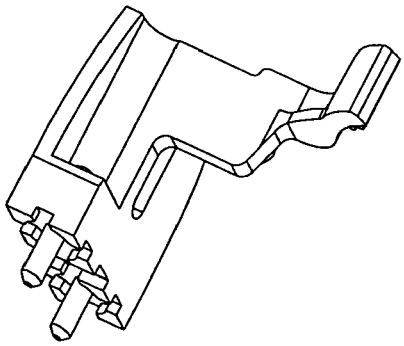
Figure 18:
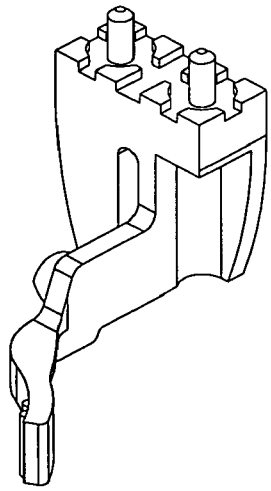

With reference to FIGS. 13 and 14, an electronic system 130 according to some embodiments of the invention includes a system board 131 and a connector 122 mounted on the system board 131. An electronic card 133 is attached to the connector 122 and overhangs the connector 122 (e.g. at least on an inward end of the card 133 with respect to an outer wall of the system chassis). The system 130 further includes the guide 124 secured to the system board 131, where the guide 124 is adapted to inhibit lateral movement of the card 133. In some embodiments, the guide 124 may be spaced from the connector 122. In some embodiments, the guide 124 may abut the connector 122. In some embodiments, the guide 124 may be integral with the connector 122.

For example, the walls 124*a* and 124*b* of the guide 124 may contact one or more side surfaces of the card 133 to reduce the amount the card 133 may flex about the pivot point near the end of the connector 122. Preferably, the guide 124 is adapted to provide a side constraint which substantially prevents lateral flexing of the card 133 at the point where the guide 124 contacts the card 133. The card 133 includes an extension (e.g. a retention tab) 135 which is positioned outside the slot 126 when the card 133 is seated in the connector 122. A surface of the protrusion 128 engages a surface 137 of the tab 135 to inhibit removal of the card 133 or other Z-axis movement of the card 133 out of the connector 122.

When inserting the card 133, the user may contact the contact surface 129 of the arm 125 to move the protrusion out of the way for card insertion. Preferably, the protrusion 128 includes an angles surface 127 which reduces the need for the user to move the protrusion 128 out of the way during card insertion. During insertion, an edge of the tab 135 contacts the angled surface 127 and deflects the resilient arm 125. When the card 133 is seated, the tab 135 is clear of the protrusion 128 and the protrusion 128 snaps into place to aid in the retention of the card 133. To remove the card 133, the arm 125 is bent out of the way and the card 133 may be pulled out of the connector 122 without substantial impediment from the protrusion 128. Another surface (e.g. the surface adjacent to surface 127) of the protrusion 128 may also be beveled to allow for less deflection of the arm 125 during removal of the card 133.

With reference to FIGS. 15-18, another retention mechanism according to some embodiments of the invention provides a one piece guide with an integral latch. A retention mechanism 150 includes a guide 154 having spaced apart walls 154*a* and 154*b* defining a slot 156 therebetween. A resilient arm 155 extends parallel to the slot 156 from the wall 154*a* (although some embodiments may include a resilient arm along wall 154*b*). The arm 155 includes a protrusion 158 which extends inward toward the slot 156. At the end of the cantilevered arm 155, distal to the guide 154, the arm includes a ribbed contact surface 159 for contact by a user. The protrusion 158 is adapted to cooperate with a corresponding feature in an add-in card, to inhibit removal of the card. The arm 155 may be vertically positioned at any suitable location along the wall 154*a*, although in some embodiments positioning the arm 155 near the top of the wall 154*a* may be preferred.

Figure 19:
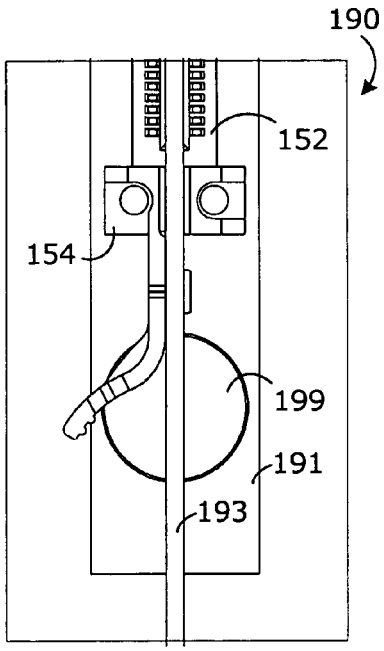
FIG. 19 is a fragmented, top schematic view of another electronic system utilizing the retention mechanism from FIG. 15.
Figure 20:
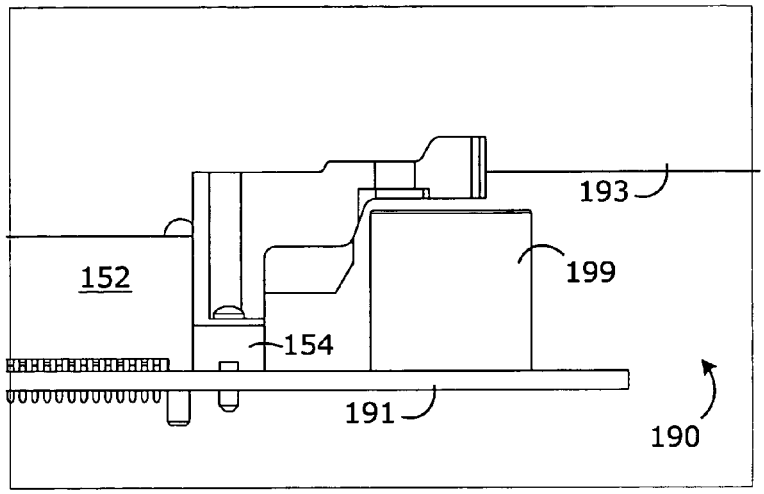
FIG. 20 is a fragmented, side schematic view of the electronic system from FIG. 19.
Figure 21:
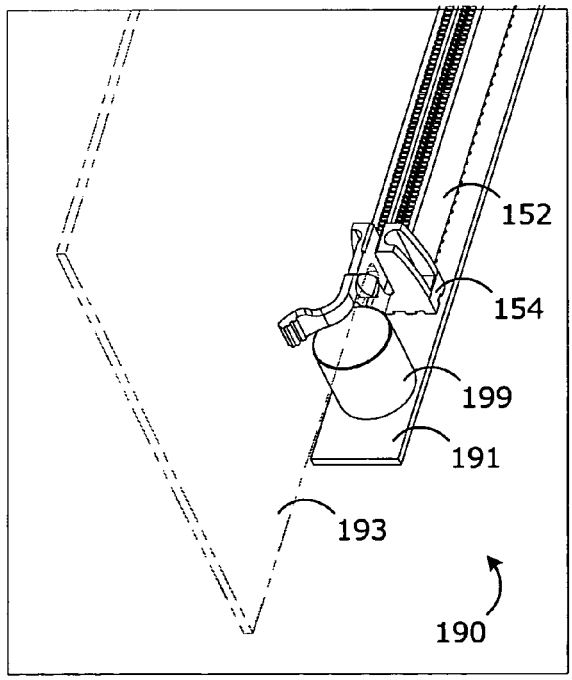
FIG. 21 is a fragmented, perspective view of the electronic system from FIG. 19.

With reference to FIGS. 19-21, an electronic system 190 according to some embodiments of the invention includes a system board 191 and a connector 152 mounted on the system board 191. An electronic card 193 is attached to the connector 152 and overhangs the connector 152 (e.g. at least on an inward end of the card 193 with respect to an outer wall of the system chassis). The system 190 further includes the guide 154 secured to the system board 191, where the guide 154 is adapted to inhibit lateral movement of the card 193. In some embodiments, the guide 154 may be spaced from the connector 152. In some embodiments, the guide 154 may abut the connector 152. In some embodiments, the guide 154 may be integral with the connector 152.

For example, the walls 154*a* and 154*b* of the guide 154 may contact one or more side surfaces of the card 193 to reduce the amount the card 193 may flex about the pivot point near the end of the connector 152. Preferably, the guide 154 is adapted to provide a side constraint which substantially prevents lateral flexing of the card 193 at the point where the guide 154 contacts the card 193. The card 193 includes an extension (e.g. a retention tab) which is positioned outside the slot 156 when the card 193 is seated in the connector 152. A surface of the protrusion 158 engages a surface of the tab to inhibit removal of the card 193 or other Z-axis movement of the card 193 out of the connector 152.

When inserting the card 193, the user may contact the contact surface 159 of the arm 155 to move the protrusion out of the way for card insertion. Preferably, the protrusion 158 includes an angles surface 157 (see FIG. 15) which reduces the need for the user to move the protrusion 158 out of the way during card insertion. During insertion, an edge of the tab 195 contacts the angled surface 157 and deflects the resilient arm 155. When the card 193 is seated, the tab 195 is clear of the protrusion 158 and the protrusion 158 snaps into place to aid in the retention of the card 193. To remove the card 193, the arm 155 is bent out of the way and the card 193 may be pulled out of the connector 152 without substantial impediment from the protrusion 158. Another surface (e.g. the surface adjacent to surface 157) of the protrusion 158 may also be beveled to allow for less deflection of the arm 155 during removal of the card 193.

As compared to the retention mechanism of FIG. 12, the distance between the arm 155 and the board 191 varies along the length of the arm 155, preferably with the distance increasing along the length. The system 190 may include an optional component 199 (e.g. a capacitor or other electronics device) mounted on the system board and positioned between the arm 155 and the system board 191. Advantageously, the greater distance between the board 191 and the arm 155 allows a taller component to be positioned under the arm 155.

A method according to some embodiments includes providing a system board, mounting a connector on the system board, attaching an electronic card to the connector, the card overhanging the connector at least on an inward end of the card; and securing a guide to the system board spaced from the connector, providing a latch connected to the guide, inhibiting lateral movement of the card with the guide; and inhibiting removal of the electronic card from the connector with the latch.

The foregoing and other aspects of the invention are achieved individually and in combination. The invention should not be construed as requiring two or more of such aspects unless expressly required by a particular claim. Moreover, while the invention has been described in connection with what is presently considered to be the preferred examples, it is to be understood that the invention is not limited to the disclosed examples, but on the contrary, is intended to cover various modifications and equivalent arrangements included within the spirit and the scope of the invention.

What is claimed is:

1. An electronic system, comprising:

a system board;

a connector mounted on the system board;

an electronic card attached to the connector, the card overhanging the connector at least on an inward end of the card;

a guide secured to the system board, wherein the guide is adapted to inhibit lateral movement of the card; and a latch connected to the guide and adapted to aid in retaining the electronic card in the connector, wherein the guide is adapted to provide a side constraint which substantially prevents lateral flexing of the card at a point where the guide contacts the card.

2. An electronic system, comprising:

a system board;

a connector mounted on the system board;

an electronic card attached to the connector, the card overhanging the connector at least on an inward end of the card;

a guide secured to the system board, wherein the guide is adapted to inhibit lateral movement of the card; and a latch connected to the guide and adapted to aid in retaining the electronic card in the connector, wherein the guide contacts one or more side surfaces of the card.

3. The system of claim 2, wherein the guide contacts two opposed side surfaces of the card.

4. The system of claim 2, wherein the guide is positioned along a bottom edge of the card.

5. The system of claim 2, wherein the latch is adapted to cooperate with a feature on the electronic card.

6. The system of claim 2, wherein the latch is adapted to engage with an opening in the electronic card.

7. The system of claim 2, wherein the guide includes a side wall and the latch is connected to the side wall.

8. The system of claim 7, wherein the latch comprises a lever which pivots about an axis which is parallel with a lengthwise axis of the connector.

9. The system of claim 8, wherein the latch includes a base portion between the pivot axis and the system board and wherein the base portion is adapted to aid in the removal of the electronic card from the connector.

10. The system of claim 7, wherein the guide and the latch comprises a one-piece assembly.

11. A method, comprising:

providing a system board;

mounting a connector on the system board;

attaching an electronic card to the connector, the card overhanging the connector at least on an inward end of the card; and securing a guide to the system board;

providing a latch connected to the guide;

inhibiting lateral movement of the card with the guide; and inhibiting removal of the electronic card from the connector with the latch, wherein inhibiting lateral movement of the card comprises providing a side constraint with the guide which substantially prevents lateral flexing of the card at a point where the guide contacts the card.

12. A method, comprising:

providing a system board;

mounting a connector on the system board;

attaching an electronic card to the connector, the card overhanging the connector at least on an inward end of the card; and securing a guide to the system board;

providing a latch connected to the guide;

inhibiting lateral movement of the card with the guide; and inhibiting removal of the electronic card from the connector with the latch, wherein inhibiting lateral movement of the card comprises contacting one or more side surfaces of the card with the guide.

13. The method of claim 12, wherein the guide contacts two opposed side surfaces of the card.

14. The method of claim 12, wherein the latch is adapted to cooperate with a feature on the electronic card.

15. The method of claim 12, further comprising: engaging an opening in the electronic card with the latch.

16. The method of claim 12, wherein the guide includes a side wall and the latch is connected to the side wall.

17. The method of claim 16, wherein the latch comprises a lever which pivots about an axis which is parallel with a lengthwise axis of the connector.

18. The method of claim 17, wherein the latch includes a base portion between the pivot axis and the system board and wherein the base portion is adapted to aid in the removal of the electronic card from the connector.

* * * * *